US007309150B2

(12) United States Patent
Vendrick

(10) Patent No.: US 7,309,150 B2
(45) Date of Patent: Dec. 18, 2007

(54) HANGER FOR LIGHT STRINGS

(76) Inventor: Jack Vendrick, 4097 Price Bridge La., Walterboro, SC (US) 29488

( * ) Notice: Subject to any disclaimer, the term of this patent is extended or adjusted under 35 U.S.C. 154(b) by 179 days.

(21) Appl. No.: 11/034,576

(22) Filed: Jan. 13, 2005

(65) Prior Publication Data

US 2006/0152927 A1 Jul. 13, 2006

(51) Int. Cl.
*F21V 21/008* (2006.01)

(52) U.S. Cl. ..... 362/391; 362/249; 362/152

(58) Field of Classification Search ..... 362/391, 362/152, 145, 249, 457; 248/309.1, 311.2, 248/314, 316.7, 316.8; 52/24–26, 28, 749.12
See application file for complete search history.

(56) References Cited

U.S. PATENT DOCUMENTS 4,714,219 A * 12/1987 Mayse ..... 248/65
4,795,121 A 1/1989 Comito
4,901,212 A 2/1990 Prickett
4,974,128 A 11/1990 Prickett
5,581,956 A 12/1996 Fennessy et al.
5,613,656 A 3/1997 Protz, Jr.
6,279,797 B1 8/2001 Snyder
6,663,069 B1 12/2003 Norberg
2002/0000504 A1 1/2002 Bayne
2003/0066938 A1* 4/2003 Zimmerman ..... 248/301

* cited by examiner

*Primary Examiner*—Sandra O'Shea
*Assistant Examiner*—Sharon Payne
(74) *Attorney, Agent, or Firm*—B. Craig Killough

(57) ABSTRACT

A hanger or bracket for hanging light strings. The hanger or bracket holds a light bulb of the light string and the adjoining conductor. The light bulb and conductor can be quickly and easily placed within the hanger, and the hanger mounted to a building, or other structure, or to a plant, such as a tree.

14 Claims, 2 Drawing Sheets

HANGER FOR LIGHT STRINGS

FIELD OF THE INVENTION

This invention is a hanger or bracket for strings of lights.

BACKGROUND OF THE INVENTION

Strings of lights ("light strings") are used for decorative purposes. Strings of lights are typically characterized by relatively small light bulbs that are connected by conductive wires that deliver electricity to the individual light bulbs. The bulbs may be wired in series or parallel. The light strings may be monochromatic, or they may be multicolored.

Light strings are frequently used for decoration. In particular, light strings are used during holiday seasons to decorate both residences and commercial buildings. Light strings may also be used to call attention to a building for commercial purposes during any season.

Particularly when lights are used during the holiday season, light strings are used for a short period of time, then taken down. There is a need for a convenient way to easily hang light strings on buildings, and to take the light strings down for storage.

SUMMARY OF THE PRESENT INVENTION

The present invention is a hanger or bracket for hanging light strings. The hanger or bracket provides a hanger which will hold one of the light bulbs of the light string and the adjoining conductor. The light bulb and conductor can be quickly and easily placed within the hanger, and the hanger mounted to a building, or other structure, or to a plant, such as a tree.

DETAILED DESCRIPTION OF THE PREFERRED EMBODIMENT

Figure 1:
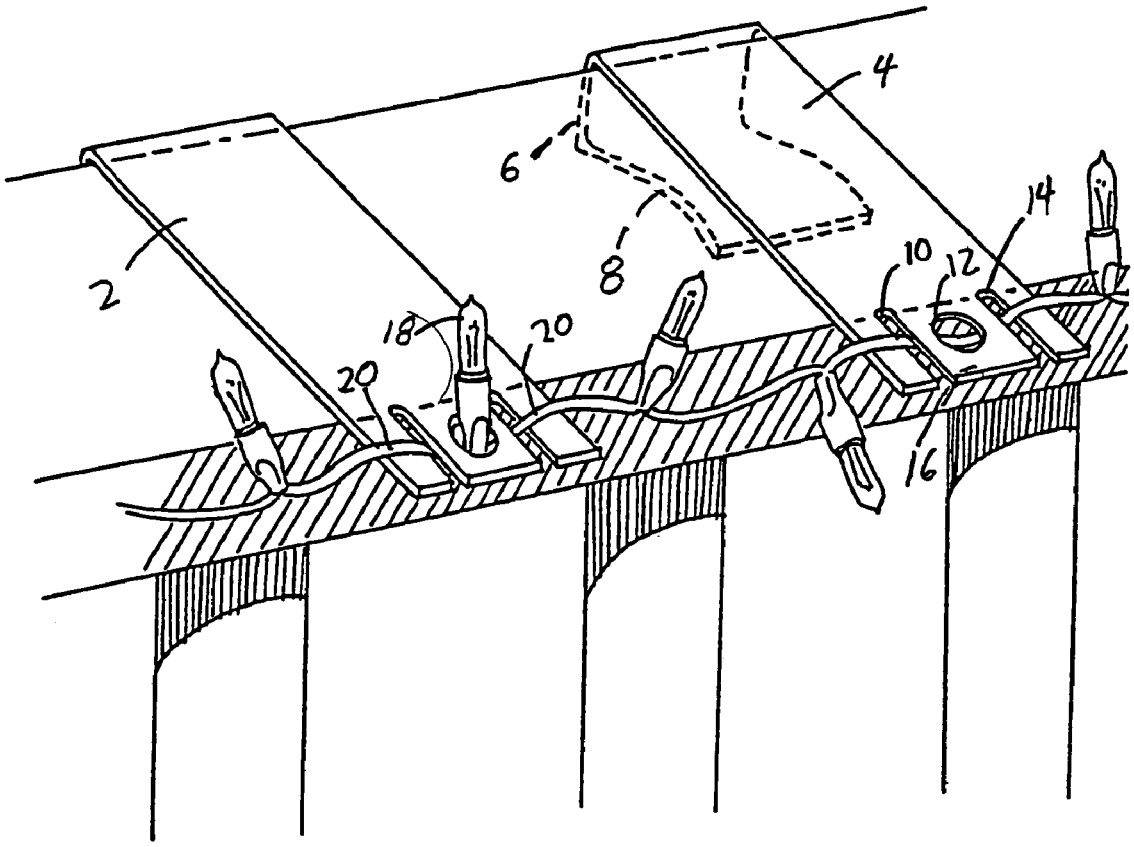
FIG. 1 shows a perspective view of hangers according to the present invention, with the hangers used to hold a light string.

Referring now to FIG. 1, two hangers 2 according to the preferred embodiment are shown. The individual hanger is preferred to have an overall shape that is generally like the letter "J." The hanger has a blade 4 that is an elongated flat plane. A first leg 6 extends generally at a right angle from the blade, and a second leg 8 extends generally at a right angle from the first leg, and toward the blade, to form a "J" shape. The second leg is preferred to be shorter than the blade.

The second leg is preferred to have an arcuate or complex shape as shown by the ghost lines in FIG. 1. In one embodiment, the first leg joins the blade at a slightly acute angle that is just less than 90 degrees. The second leg and the blade are generally parallel, but the second leg is displaced somewhat toward the blade, due to the slightly acute angle where the first leg joins the blade, and the arcuate shape of the second blade. The hanger is preferred to be made of resilient material so that the second leg can be forced away from the blade for hanging the hanger on an object, with spring tension from the resilient property of the material pushing the second leg back toward the blade when the pressure is released. The spring tension or biasing assists in holding the hanger in position on the object.

The first leg is preferred to join the blade at one end of the blade. On the opposite end of the blade, a slot 10 is present. The slot is generally parallel to the sides of the blade, and one end of the slot intersects the end 16 of the blade that is opposite the end from which the first leg extends. Adjacent to the slot is an annular void 12. In the preferred embodiment, the annular void does not intersect the slot or the end of the blade. The annular void may be round in shape. In the preferred embodiment, an additional slot 14 is provided in the blade. The additional slot is parallel to the first slot and intersects the end 16 of the blade as shown in the drawing figures. The slots are generally parallel to each other, and are positioned on either side of the annular void, and extend from one end of the blade and past the annular void.

The device is preferred to be formed of plastic, such as an ABS plastic or plexiglass. However, the device could be formed of any suitable material, including metal or fiberglass. In preferred embodiment the hangers are substantially transparent, so that they are not easily noticed.

In use, a light bulb 18 from the light string may be inserted through the annular void, with the annular void receiving the light bulb, so that the light emitting part of the light bulb is above the blade. The adjoining conductor 20 is routed through the first slot 10 so that a portion of the conductor is above the blade, and the portion of the conductor that intersects the light bulb is below the blade. The portion of the conductor that is on the opposite side of the bulb extends through the second slot, and is above the blade. As shown in FIG. 1, it is not necessary for every bulb to be placed within a hanger. It is only necessary to place sufficient bulbs through the hangers to hold light string in place as desired, which usually means that sufficient hangers are used so that the light string will not materially sag.

The light bulb may be any light emitting device such as an incandescent bulb or light emitting diode. Most commonly, the light bulb will be a small incandescent bulb as used in common light strings.

It is not always necessary to insert a bulb through the annular void, as shown in FIG. 1. The hanger may be used to hold sections of the conductor, without a bulb, by routing a portion of the conductor over the blade, and an adjoining portion under the blade and through the second slot, and then over the blade. The length of the slots as shown adequately hold the conductor.

Figure 2:
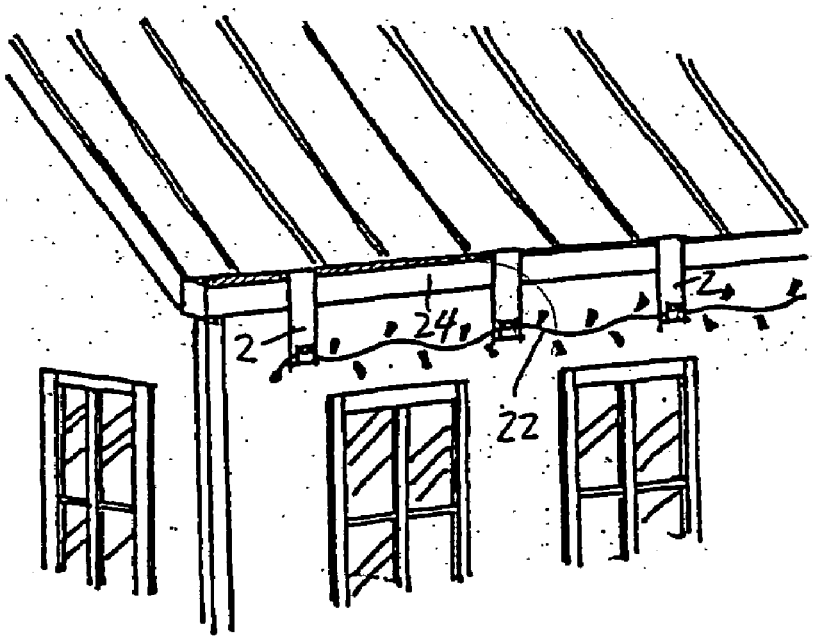
FIG. 2 shows a series of hangers for light strings in use on a building.

As shown in FIG. 2, a series of hangers may be used to hold the light string 22 in a gutter 24 or similar structure on a house. The light string is intermittently inserted into a hanger as described, with the hangers in an inverted J position and hanging in the gutters.

Figure 3:
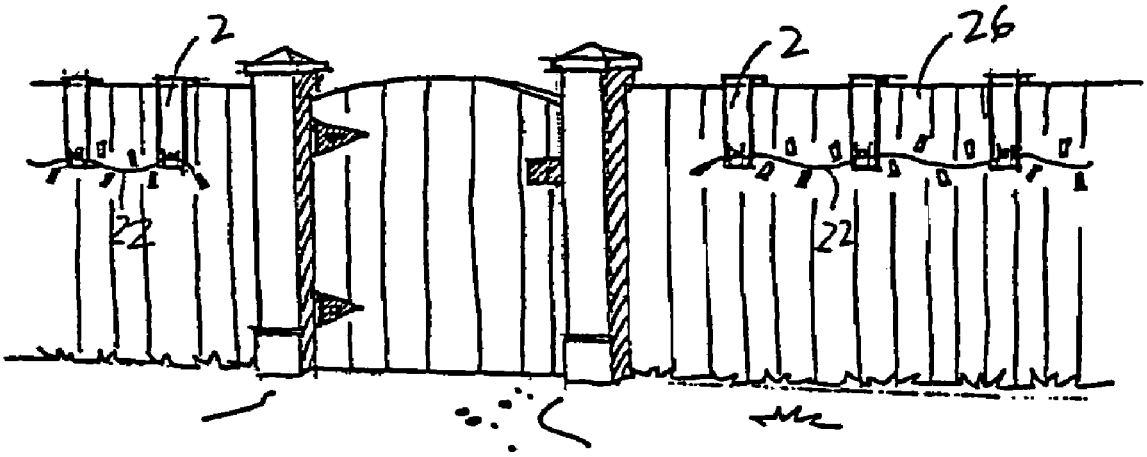
FIG. 3 shows an alternate use of a series of the hangers for light strings according to the present invention.

It is shown in FIG. 3, the hangers may be placed in an inverted J position, and used to hang the lights on a structure such as a fence 26. As shown, the hangers used intermittently with the lights, and hung so that a gap is left for the gate in the fence.

What is claimed is:

1. A hanger for light strings comprising a blade, said blade comprising an annular void for receiving a light bulb, wherein said annular void is near a first end of said blade, and said blade comprising at least two slots that intersect said first end of said blade, wherein said at least two slots divide said first end of said blade into a left section, a right section and a center section, and wherein an elongated conductor is received in said at least two slots, and a first portion of said elongated conductor is positioned over said left section of said blade and a second portion of said elongated conductor is positioned over said right section of said blade, and wherein said first portion of said elongated conductor and said second portion of said elongated conductor that are positioned over said left section of said blade and said right section of said blade are above a top surface of said center section of said blade.

2. A hanger for light strings as described in claim 1, wherein at least one of said at least two slots does not intersect said annular void.

3. A hanger for light strings as described in claim 1, wherein said hanger further comprises a first leg that extends from said blade at substantially a right angle.

4. A hanger for light strings as described in claim 3, further comprising a second leg that extends from said first leg at substantially a right angle.

5. A hanger for light strings as described in claim 4, wherein said first leg extends from a second end of said blade that is opposite said first end, and said first leg extends from said blade and said second leg extends from said first leg so that said hanger forms a "J" shape.

6. A hanger for light strings as described in claim 1, wherein said at least one of said at least two slots extends from said first end generally parallel to a first side of said blade.

7. A hanger for light strings as described in claim 5, wherein at least one of said at least two slots extends from said first end of the blade toward a second end of said blade and beyond a side of said annular void that is closest to said second end of said blade.

8. A hanger for light strings as described in claim 6, wherein at least one additional slot of said at least two slots is generally parallel to said first side of said blade.

9. A hanger for light strings as described in claim 1, wherein at least one of said at least two slots is opposite said annular void from at least one other of said at least two slots.

10. A hanger for light strings comprising a blade, said blade comprising:

a first slot that intersects said first end of said blade; and a second slot that intersects said first end of said blade, wherein said first slot and said second slot divide said first end of said blade into a left section, a right section and a center section, and wherein substantially an entire top surface of said left section, an entire top surface of said right section and an entire top surface of said center section are in the same plane, and wherein said hanger further comprises means for attaching said blade to another object.

11. A hanger for light strings as described in claim 10, further comprising an annular void that is located in said center section of said blade and between said first slot and said second slot.

12. A hanger for light strings as described in claim 10, wherein said blade is formed of a relatively flat material having said first slot and said second slot formed therein, and wherein said left section, said right section, and said center section are substantially entirely in the same plane.

13. A hanger for light strings as described in claim 10, wherein substantially an entire bottom surface of each of said left section, said right section and said center section of said blade are in the same plane.

14. A hanger for light strings as described in claim 10, wherein an elongated conductor is received in each of said first slot and said second slot, and a first portion of said elongated conductor is positioned over said left section of said blade and a second portion of said elongated conductor is positioned over said right section of said blade, and wherein said first portion of said elongated conductor and said second section of said elongated conductor that are positioned over said left section of said blade and said right section of said blade are above a top surface said center section of said blade.

* * * * *